United States Patent [19]

Gössler et al.

[11] 4,371,780

[45] Feb. 1, 1983

[54] MULTI-ELEMENT COOKING UNIT WITH CONTROL DEVICE

[75] Inventors: Gerhard Gössler, Oberderdingen; Heinz Petri, Bretten; Hans Mayer, Kürnbach, all of Fed. Rep. of Germany

[73] Assignee: E.G.O. Elektro-Beräte Blanc u. Fischer, Fed. Rep. of Germany

[21] Appl. No.: 199,948

[22] Filed: Oct. 23, 1980

[30] Foreign Application Priority Data

Oct. 27, 1979 [DE] Fed. Rep. of Germany ..... 2943477
May 14, 1980 [DE] Fed. Rep. of Germany ..... 3018416

[51] Int. Cl.[3] ..... H05B 1/02

[52] U.S. Cl. ..... 219/446; 219/448; 219/464; 338/134

[58] Field of Search ..... 219/446, 451, 460, 480; 338/172, 198, 200, 128, 129, 131, 134; 200/5, 6 A, 6 AB, 6 B

[56] References Cited

U.S. PATENT DOCUMENTS

| | | | |
|---|---|---|---|
| 1,346,793 | 7/1920 | Bunnel et al. | 219/446 |
| 2,232,663 | 2/1941 | Meyers | 338/172 |
| 2,650,270 | 8/1953 | Mucher | 338/172 |
| 2,804,531 | 8/1957 | Dadson | 219/446 |
| 2,942,221 | 6/1960 | Girolamo | 338/200 |
| 4,158,127 | 6/1979 | Husslein | 219/446 |

FOREIGN PATENT DOCUMENTS

| | | | |
|---|---|---|---|
| 2625715 | 12/1977 | Fed. Rep. of Germany . | |
| 2847843 | 5/1980 | Fed. Rep. of Germany | 338/200 |

*Primary Examiner*—Bernard Roskoski
*Attorney, Agent, or Firm*—Steele, Gould & Fried

[57] ABSTRACT

A cooking and/or heat-maintaining unit comprises a main heating element and an auxiliary element adjacent thereto. A control therefor comprises a regulating or control device having a rotary setting member with a shaft for adjusting the power or temperature, as well as a switching member for switching an additional heating system on or off, the switching member having a switching shaft arranged coaxially with the shaft on the setting member. The switching member is operable by rotation of the setting member to a given angular setting, the setting member and switching member being independent until the angular setting is reached. The switching member preferably further comprises a quick-action switch with stable limiting positions, operable by the setting member, and which in one of the limiting positions operates a contact for switching the additional heating system on.

8 Claims, 16 Drawing Figures

FIG. 8
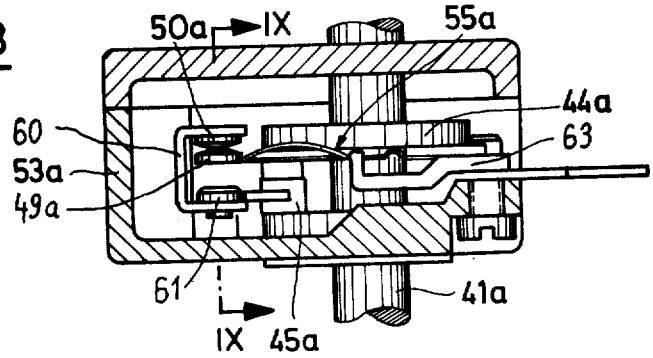
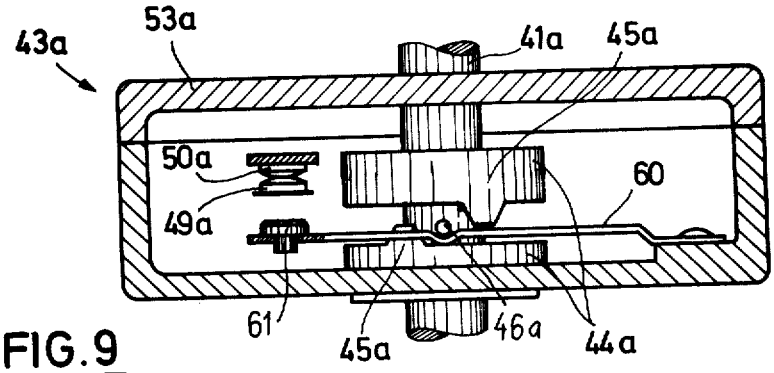
FIG. 9
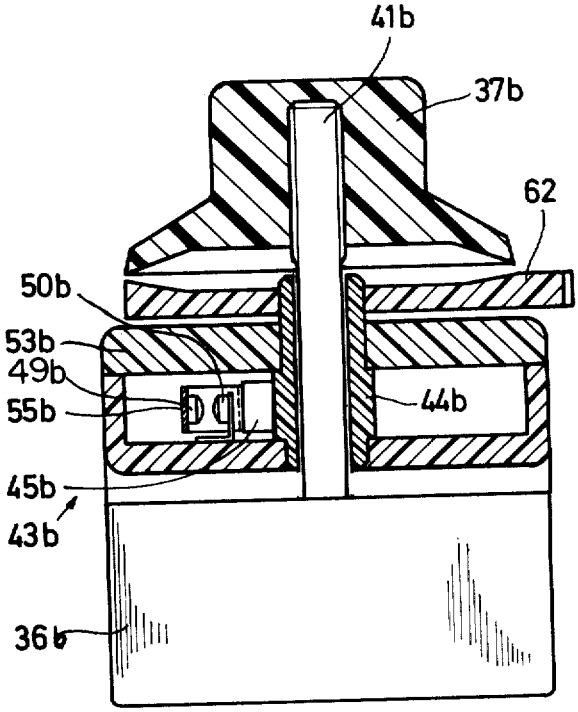
FIG. 10

FIG.11
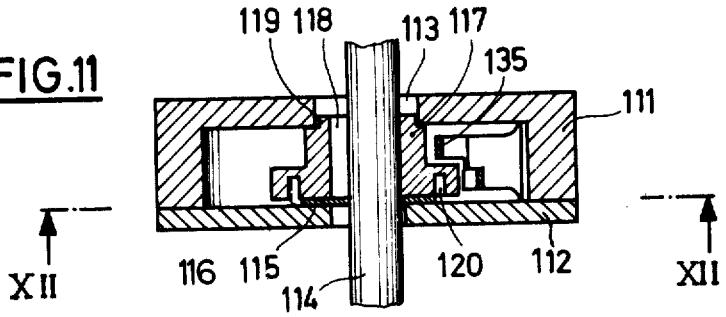
FIG.12
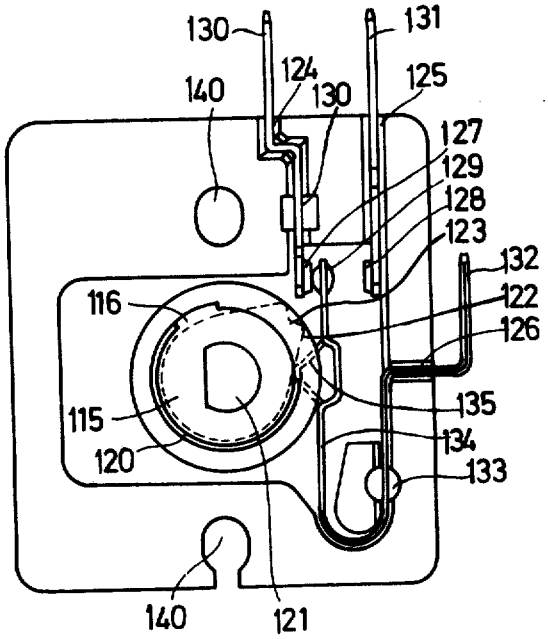
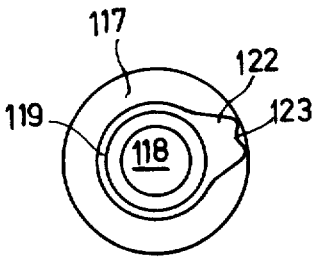
FIG.13
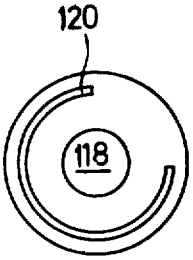
FIG.14

MULTI-ELEMENT COOKING UNIT WITH CONTROL DEVICE

The invention relates to a switch for switching on an additional heating system for hot plates and/or heat-maintaining plates with a rotary power or temperature setting device.

In order to provide a universal heating unit with a size or shape which can be adapted to the size or shape of cooking vessels or articles to be kept hot, it is proposed to provide an indirect main heating element with lateral additional heating elements. In order to be able to switch these on as desired, it would be possible to provide two power regulators or thermostats, which can be switched on as required.

The object of the invention is to provide a simpler solution, i.e. to provide a switch of the aformentioned type which makes it possible to switch on the additional heating system under the simplest possible operating conditions.

This object is achieved in a regulating or control device which contains a switching element for switching on or off an additional heating system, whose switching shaft is coaxial to the setting member.

Thus, in order to set a particular power or temperature, the user need only set the switch from the off-position to the desired value in one or the other direction in order to switch the additional heating system on or off. Preferably, the setting member forms part of a regulating or control device, which regulates or controls the power of the main and additional heating elements.

The switching member can preferably have a quick-action switch with stable limiting positions and operated by the setting member. In one of the limiting positions, the switch closes a contact for the additional heating device. Thus, this quick-action switch is operated by switching members, for example cams which, for example, are located adjacent to the off-position of the switch and on deflection from this position force the quick-action switch in one or the other direction.

It is also possible for the setting member belonging to the regulating or control device according to the invention to be rotatable by a specific angle of less than 360°. The switching member is disposed in a casing which can be mounted on the setting member and contains a cam mounted upon and non-rotatable with respect to the setting shaft and which engages in a recess in a cam plate arranged in rotatable manner in the casing permitting a limited rotary movement which actuates the contact or contacts. In order to switch on the additional heating system, it is merely necessary for the user to rotate the switch from the off-position into a given angular position in which the additional heating system is switched on, after which the switch is turned back to the desired value. If it is desired to set a particular desired value without switching on the additional heating system, the switch is turned directly from the off-position to the desired value.

The switching member is preferably constructed as an adaptor switch for a power regulator or a thermostat. In order to be able to fix this adjusting mechanism in the conventional manner after fitting the switching member, the casing of the latter has on its side remote from the adjusting mechanism casing a fastening device corresponding to that of the power regulator or thermostat.

A particularly simple operation of the contact or contacts is possible if the cam plate has a trip cam with a depression in the vicinity of its apex which serves to produce a certain arresting action in the connected state.

In a particularly advantageous manner, the switch can be used in connection with a heating element for a glass ceramic cooking unit with a support depression located below a glass ceramic plate in which electrical heating resistors are arranged in the central area of the depression in the form of a substantially circular main heating element. The switch makes it possible to switch in additional elements arranged on either side of the main heating element and which supplement the complete heated surface area to give an elongated rectangle, optionally with rounded corners.

The symmetrical arrangement of the main and additional heating elements is most advantageous from the optical and operational standpoints, because there can be virtually no confusion between the main and additional heating element. In addition, the temperature distribution is very uniform, so that overheated areas (hot spots) do not occur on heating.

Further advantages and features of the invention can be gathered from the subclaims and description in conjunction with the drawings. Embodiments of the invention are described hereinafter relative to the drawings, wherein:

FIG. 8 is a section through a variant of a switch.

FIG. 9 is a section along the line IX—IX of FIG. 8.

FIG. 10 is another variant of a switch connected to a thermostat.

FIG. 11 is a cross-section through an additional switching member according to the invention.

FIG. 12 is a view of the switching member, approximately in the direction of arrow XII in FIG. 11.

FIG. 13 is a view of the cam plate in a direction opposite to arrow XII in FIG. 11.

FIG. 14 is a view of the cam plate in the opposite direction.

Figure 1:
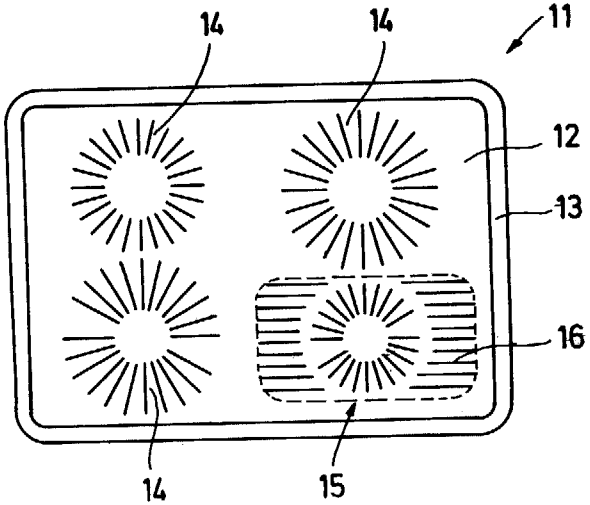
FIG. 1 is a plan view of a glass ceramic cooking unit.

The glass ceramic cooking unit 11 has a glass ceramic hob 12 covering four hot plates and bounded by a frame 13. It forms a fitting depression which can be inserted in an opening of cookers and the like. Beneath the glass ceramic hob there are heating means for three substantially circular or circular ring-shaped hot plates 14 marked at the top by etching, colouring or the like. There is also a hot plate 15 which, as shown in FIG. 1, has a central S-shaped, heated zone and following onto this lateral heated zones. They can be indicated on the top by a corresponding marking or structure 16.

Figure 3:
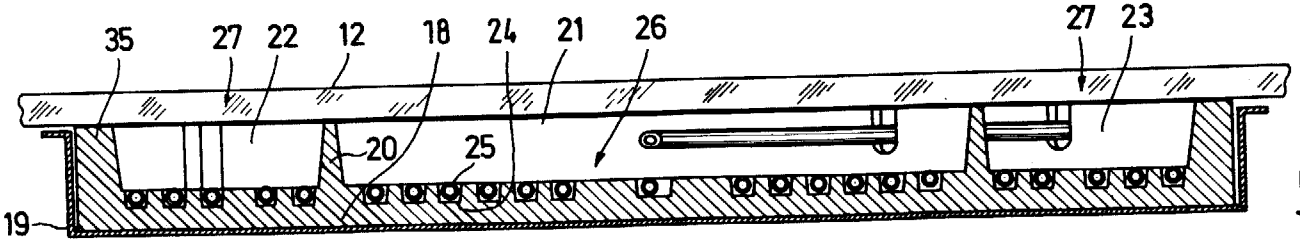
FIG. 3 is a section along the line III—III of FIG. 2.
Figure 2:
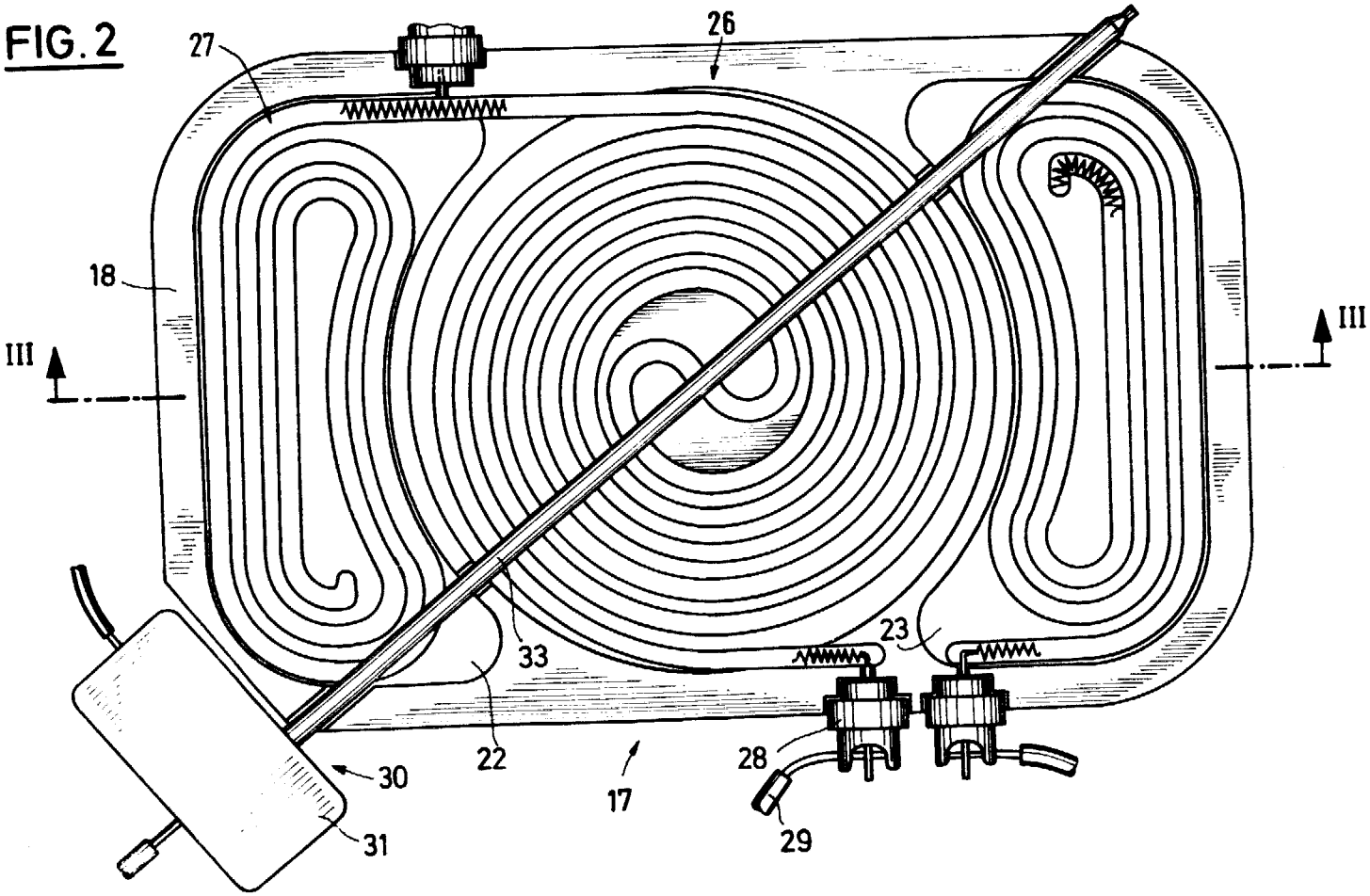
FIG. 2 is a plan view of a supporting depression for a glass ceramic plate which has been removed.

The heating system 17 for hot plate 15 is shown in detail in FIGS. 2 and 3. It comprises a heat-resistant insulating material, for example a support shell 18 made as a moulded article from ceramic fibres and located in a sheet metal shell 19 (FIG. 3). Although not shown, it is pressed onto the bottom of the glass ceramic hob 12 by means of its upwardly directed outer edges.

The support shell 18 is subdivided by webs 20 extending up to the glass ceramic hob into three thermally separate areas 21, 22, 23, which are in particular screened from one another with respect to radiation.

The central area 21 is circular and has on its base, i.e. at a considerable distance from the glass ceramic hob, slots 24 arranged in spiral manner in such a way that the two ends are located on the outer periphery. A heating resistor 25 in the form of a filament coil is placed in these spiral slots.

The two areas 22, 23 follow onto either side of the circular central area 21 so as to face one another and together with the circular area form an elongated quadrangle with significantly rounded corners. Thus, the two outer areas 22, 23 have outer and lateral edges connected together by rounded corners and a round inner edge constricting the central area thereof. Here again, heating resistors are placed in the slots 24. The slots run spirally from the inside to the outside and essentially have a B-shape with a straight side, two following rounded portions and a side which is curved inwards and faces the straight side. The heating resistor in area 22 follows directly onto that of area 21 and also projects through an opening in web 20, while the heating resistor in area 23 is inserted independently of the others.

Thus, three heating elements are provided, namely a central and substantially circular main heating element 26 and two lateral, following additional heating elements 27. By means of connecting pieces 28 and corresponding leads 29, they can be connected in such a way that the main heating element 26 can be switched on independently of the additional heating elements.

A thermostat 30 is provided on the bottom of the glass ceramic hob for limiting the temperature. It comprises a switch head 31 with a quick-action switch 32 (FIG. 4), which can optionally contain a signal contact actuating a warning lamp against touching the hot plate when heated and a long, rod-like temperature sensor 33, which projects diagonally over the entire heating unit 17. It crosses the main heating element 26 in a substantially diametrical manner (but can also be displaced relative thereto) and passes the corners of the two lateral support shell areas 22, 23 in such a way that it projects beyond the additional heating elements 27. The temperature sensor 33 is located between the heating resistors and the glass ceramic hob and passes through U-shaped cutouts in the webs. It also projects through the edge 35 of support shell 18, so that one end is freely accessible for adjustment purposes and the switch head 31 is also located outside the heated housing. The rod-like temperature sensor is formed in per se known manner from a quartz glass expansion sleeve and a metallic rod located therein having a greater thermal expansion.

Figure 4:
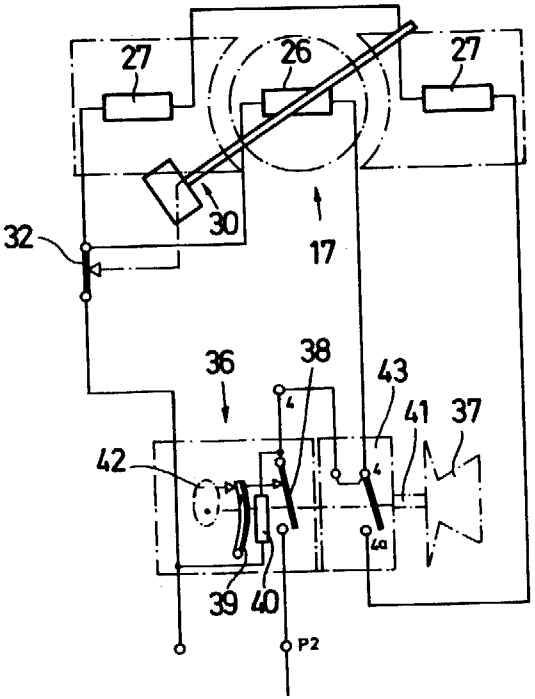
FIG. 4 is a circuit diagram of the heating system of FIGS. 2 and 3.

FIG. 4 shows the circuit of heating elements 26, 27. The two additional heating elements 27 are connected together in series independently of the main heating element 26, while the complete heating system can be switched off by switch 32 of thermostat 30. All three heating elements can be jointly controlled by a power control device 36, which is of known construction. For this purpose, it is possible to use a known power control device according to West German Auslegeschrift 2,625,715 published Dec. 15, 1977, to which reference should be made. By means of this device, the electrical power supplied to the heating elements can be continuously controlled independently of the hot plate temperature by manual setting on a setting knob 37. The power is supplied in individual power pulses of different relative connection time. For this purpose, the power control device has a quick-action switch 38 operated by a bimetal 39 heated by a controlled heating system 40 connected in parallel by the consumer. The reciprocal positioning of the bimetal and the switch is adjusted by a control cam 42 operated by the knob 37 via a setting shaft 41.

A switch 43 is mechanically preset in the power control device 36, so that setting shaft 41 passes through switch 43.

Figure 5:
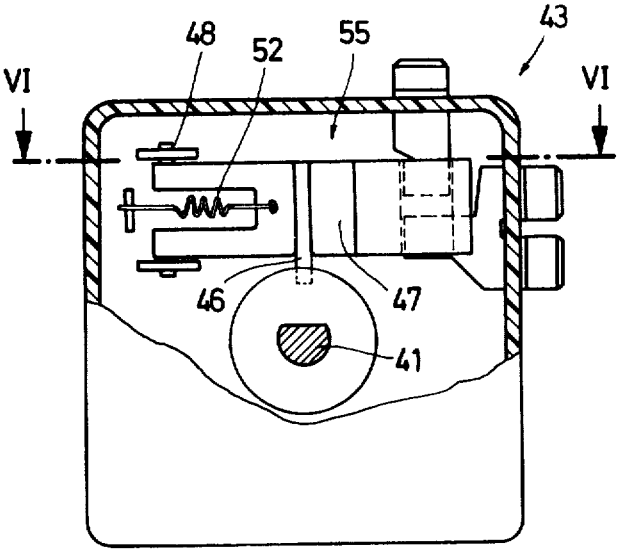
FIG. 5 is a partial section through a switch for controlling the heating system.
Figure 6:
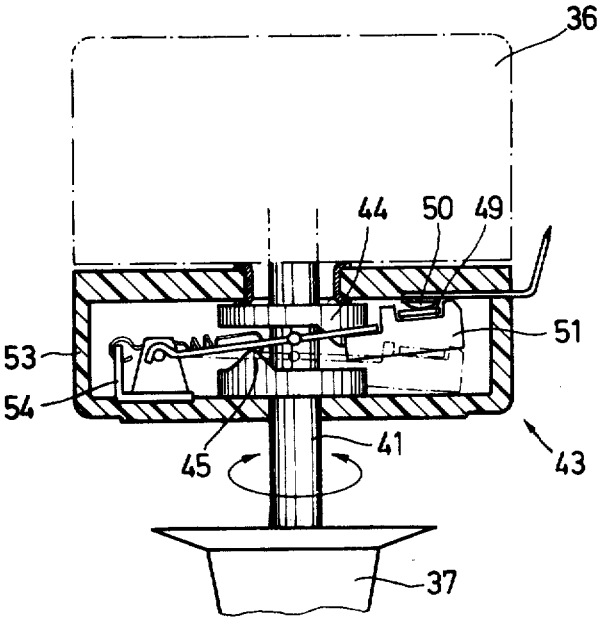
FIG. 6 is a section along the line VI—VI of FIG. 5.
Figure 7:
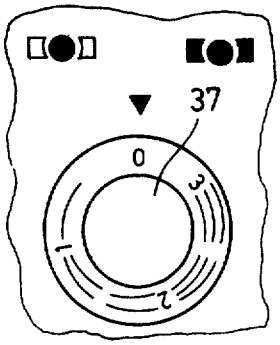
FIG. 7 is a view of a known fitted adjusting knob for the switch of FIGS. 5 and 6.

The switch 43 shown in detailed manner in FIGS. 5 and 6 is used for switching on either the main heating element 26 only or the latter together with the additional heating elements 27. This is done by rotating the setting shaft 41 in one or the other rotation direction. As the setting shaft for the power control device can be rotated by 360°, it is possible for example, on rotating knob 37 in the clockwise direction, i.e. starting with a low power, to switch on all three heating elements together, while on rotating in a counterclockwise direction, only the main heating element 26 is switched on (cf also FIG. 7).

On setting shaft 41, switch 43 has two cam plates 44 with circumferentially displaced cams 45, which face one another and between which passes a projection 46 of a switching lever. The switching lever 47 comprises a flat sheet metal part arranged laterally or tangentially to the setting shaft 41 and is pivoted at one end in a bearing 48. At its opposite free end, it has a contact bridge 49, which can cooperate with two fixed contacts 50 for the bridging thereof. Contact bridge 49 is mounted with limited mobility on an insulating member 51.

At its mounted end, the switching lever is fork-shaped and receives in the gap a tension spring 52 running in the central pivoting position (neutral position) of lever 47. One end of the tension spring 52 is fixed to the switching lever and the other end to a member 54 connected to the switch casing 53.

Projection 46 is so arranged between the cams 45 that in the case of a setting of the power control device 36 starting from the off-position of setting knob 37 (FIG. 7) the switching member 55 formed by switching lever 47, tension spring 52 and contacts 50 can be switched over. If, for example, in the position of FIG. 6, the knob 37 is rotated counterclockwise, the switching lever is forced from its upper position where it engages on contacts 50, via the neutral central position into its lower position, indicated by broken lines. Thus, it is a switching member with two stable end positions.

The switch is very flat and can be mounted on an existing power control device 36, so that an approximately cubic, compact block is formed. It would also be possible to arrange the switch on the back of the power control device. If necessary, further switching elements could be contained in its casing, for example a double-pole disconnection normally provided in the power control device 36.

Switching lever 47 could also be replaced by a switching member corresponding to a conventional quick-action switch with supported spring tongue. However, the presently shown construction is particularly robust and takes account of the fact that there is an adequate switching force. The switching lever could also be arranged with an axis parallel to the setting shaft, when the cams would act in the radial direction.

In the prsent case (cf particularly FIG. 7) the setting range takes up almost 360° on setting knob 37. However, it would also be possible to limit the setting range to a smaller angle and e.g. on turning to the right and left starting in each case with the low power, zero power facing full power, for example. This would merely require a modification of the setting cam on the power control device.

Heating system 17 of hot plate 15 can be used universally. If only the central main heating element 26 is switched on, it can be used for normal boiling and roasting processes in the same way as the remaining hot plates 14. However, if the two lateral additional heating elements 27 are switched on, an elongated, rectangular hot plate is formed which, when a small amount of power is supplied, e.g. a low setting of the power control device 36, can be used for keeping hot food which is normally located on elongated serving dishes. By means of this power control device 36, it is possible without difficulty to set power levels of approximately 5 to 7% of the total power, i.e. for a 1000 Watt power for the main heating element 27 and 500 Watt each for the additional heating elements 27, a heat-maintaining power of 100 to 140 Watt can be set, which is satisfactorily in accordance with the requirements.

However, it is also possible to use the hot plate 15 with all the heating elements at full power for roasting purposes and then this heating surface is particularly well adapted to roasting vessels e.g. oval roasters.

The symmetrical overall construction of the heating system 17 not only provides an optically attractive arrangement, but also ensures uniform conditions over the entire heating system, although the individual areas 21, 22, 23 are thermally separate to the extent that the lateral areas remain cold when only the central area is switched on. The thermostat mainly detects the main heating element 26 which is on in all operating cases, but also detects a certain proportion of the heat from the additional heating elements, so that even in the case of an asymmetrically arranged cooking vessel the corresponding access is available. The arrangement is particularly advantageous in the case of a radiant heating system, but would also be conceivable with contact heaters. In the latter case, the temperature sensor would be arranged on the side opposite to the glass ceramic hob.

The embodiment of FIGS. 8 and 9 differs from that of FIGS. 5 and 6 in that the switching member **55*a* is formed by a normal quick-action switch supported by a switch support 63 fixed to casing 53*a* and a switch spring with a spring tongue supported on the switch support. A contact 49*a* is fitted to the free end of the switch spring and cooperates with an opposing contact 50*a*. The latter faces an insulating counter-abutment 61. Contact 50*a* and counter-abutment 61 are fitted to a U-shaped member of a resilient lever 60 fastened at one side to the casing and in whose central area is fitted a tripping pin 46*a*, which cooperates with cam 45*a* on cam plates 44*a* on shaft 41*a* in the same way as the projection 46 in the embodiment of FIG. 6**.

Thus, contact **49*a* is located in the gap between opposing contact 50*a* and counter-abutment 61, movable by means of lever 60. The quick-action switch is operated from lever 60 via contact 49*a* and opposing contact 50*a* or counter-abutment 61. The quick-action switch together with the opposing contacts is aligned in such a way that it always jumps into a stable end position. Thus, in this embodiment, a normal quick-action switch can be used, which moves into one or other end position as a result of brief up or down movements of lever 60. In said end positions, the two electrical contacts 49*a*, 50*a* engage on one another, so that the additional heating element is switched on or no contact occurs due to the insulating counter-abutment 61**.

In the embodiment of FIG. 10, a power control device **36*b* has a switch 43*b* which is operated by a setting knob 37*b* via a setting shaft 41*b*. Shaft 41*b* projects in freely rotatable manner through a cam sleeve 44*b* carrying a button 45*b*, which acts on a normal leaf springlike switch spring 55*b*. On the latter is arranged an electrical contact 49*b*, which can engage with an opposing contact 50*b*. The cam sleeve 44*b* mounted in the casing 53*b* of switch 43*b* is connected so as to be non-rotatable with respect to with a setting disk or lever 62 positioned flat below knob 37*b*. Thus, there is a coaxial circuit operation. In this embodiment, the additional heating element is switched on independently of the setting of the power regulator, which can therefore be a normal power regulator with setting in only one rotation direction. By operating the setting disk 62 between two positions, the cam opens or closes contacts 49*b*, 50*b***. The switching positions can be resiliently fixed by means of a normal spring detent.

However, it is also possible to axially resiliently mount the setting knob **37*b*, so that on pressing in the button, setting disk 62 is also moved and consequently the additional heating element can be switched on or off. This switch can also be readily mounted on the power control device 36*b*** and takes up no additional space in the instrument panel of the cooker and requires no additional fitting expenditure or effort.

The additional switching member shown in cross-section in FIG. 11 contains a casing 111, covered on one side by a cover 112. On the side opposite to the cover, casing 111 has a central bore 113 through which extends the setting shaft 114 of the setting means. Casing 111 contains a cam 115 in the form of a disk having a shoulder 116 which is bent upwards approximately at right angles. Casing 111 also contains a cam plate also having a central bore through which extends the setting shaft 114. On the top of cam plate 117, there is a step 119, with the aid of which it is rotatably mounted in the central bore 113 of casing 111.

On the bottom of cam plate 117, there is a slot 120 extending around central bore 118 by an angle of 270° and in which engages the shoulder 116 (cf FIG. 12).

FIG. 12 shows that the disk-shaped cam 115 has a central opening 121, whose shape corresponds to the non-circular, cross-section of setting shaft 114 and by which the cam 115 can be connected so as to be non-rotatable with respect to shaft 114. This connection is obtained by mounting the switching member on shaft 114.

Shoulder 116 of cam 115 engages in slot 120. Since cam plate 117 can rotate in casing 111, but is not connected so as to be non-rotatable with respect to setting shaft 114, an engagement of shoulder 116 on the end of slot 120 leads to the movement of cam plate 117 on rotating shaft 114 beyond the corresponding angular position. On rotating back the setting shaft 114 cam plate 117 initially stops until shoulder 116 engages on the other end of slot 120.

At its right-hand side in FIG. 12, cam plate 117 has a cam 122 which, in the vicinity of its apex has a recess 123.

Casing 111 has three slot-like casing recesses 124, 125, 126 in each of which is inserted a metal piece passing outwards into a flat insertion tongue 130, 131, 132. Contacts 127, 128 and 129 are fitted to the end of the metal pieces located within casing 111. The casing-side end of flat insertion tongue 132 is bent into the form of a U, the outwardly directed leg being fixed in the casing. The inner leg 134, which is longer than the outer leg, carries on its end contact 129 constructed for switching over between contact 127 and contact 128. Inner leg 134 has, approximately in its center, an approximately triangular bent-out piece 135, directed towards the cam plate 117. The left-pointing tip is constructed to cooperate with the recess 123 in cam 122 of cam plate 117. Due to the elasticity of the material, the U-shape ensures the pretensioning of the movable contact 129 in the direction of the then fixed contact 127, so that cam 122 can directly engage on said leg for the pivoting thereof.

If setting shaft 114 in FIG. 12 is further rotated in the clockwise direction, cam 122 with its recess 123 moves into a position in which it pivots leg 134 and contact 129 fixed thereto to the right, said position being locked by the engagement of the bentout piece 135 in recess 123. If the setting shaft 114 is then rotated counterclockwise, this position is maintained due to the locking action until shoulder 116 engages on the opposite end of slot 120 and then also pivots the cam plate 117 counterclockwise.

Cam 122 with its recess 123 is also shown in FIG. 13. FIG. 14 shows that slot 120 runs in circular manner around the centre point of central bore 118 covering an angular range of approximately 270°.

Figure 15:
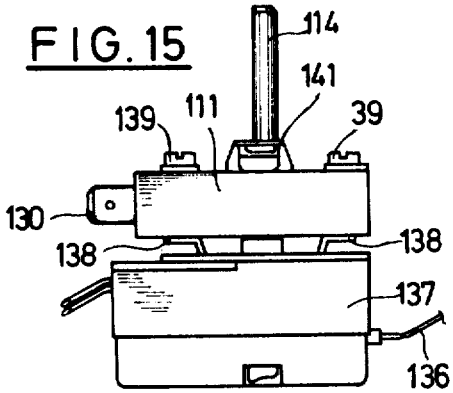
FIG. 15 is a side view of a switching member constructed according to the invention mounted on a thermostat.
Figure 16:
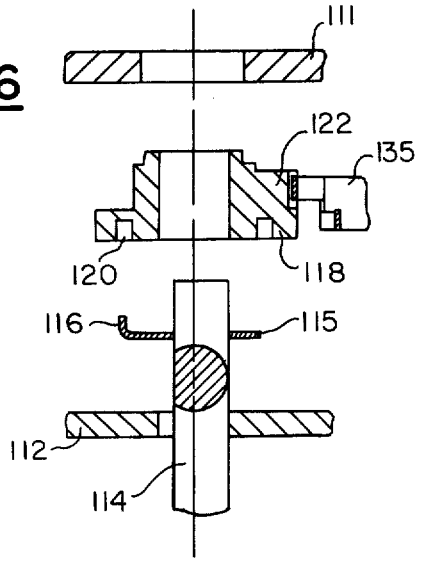
FIG. 16 is an exploded elevation view of the control of FIGS. 11-14.

FIG. 15 shows how the additional switch according to the invention is connected to a setting mechanism. In this case, it is thermostat, whose capillary tube 136 is only indicated. On either side of the setting shaft 114, the top of thermostat casing 137 has a flap by means of which normally the casing 137 can be screwed to the outer wall of a cooker or similar appliance. The casing 111 of the additional switch according to the invention is mounted from above over the front end of the setting shaft 114, so that the latter extends through the central opening 121 of cam 115, the central bore 118 of cam plate 117 and the central bore 113 of casing 111. The latter is screwed by two screws 139 to flaps 138. The screws 139 pass through holes 140. On the top of casing 111, i.e. on the side remote from the thermostat it has two flaps 141, constructed in exactly the same way as flaps 138, but which are displaced by 90° relative to the latter.

By means of the flaps 141, the unit formed by the thermostat and the additional switching member can be fixed to the same point of an existing appliance, as was previously only possible for thermostat 137 with flaps 138.

The additional switching member is suitable for mounting on any random setting mechanism having a rotary setting shaft. The non-rotatable connection with respect to the setting shaft need not be by form-locked mounting as in the present embodiment, but can also be produced by other connecting means. It is particularly advantageous to use the additional switching member in a regulating means for cooking appliances in which an additional heating system is to be switched on by initially rotating the setting knob to the right until it abuts and then turning it back to the desired position. Whereas, in the present embodiment, a changeover switch has been described, the additional switch can obviously be used for switching on or switching off only.

We claim:

1. A glass ceramic cooking unit, comprising:

a glass ceramic hob having a substantially circular main heating element and at least one additional heating element arranged adjacent the main heating element, the main and the at least one additional heating elements together forming an elongated rectangular configuration;

a rotatably mounted setting shaft, rotatable over an angular range for regulating the heating elements;

a cam fixed on the setting shaft for rotation therewith, the cam having a shoulder extending therefrom;

a cam plate rotatably mounted on the setting shaft, the cam plate having an arcuate slot, defining the angular range, for slidably receiving the shoulder of the cam, the cam plate being rotatably driven by the cam whenever the shoulder engages either end of the arcuate slot, the cam and cam plate being otherwise relatively rotatable; and, switching means having contacts operable in response to rotation of the cam plate into contact therewith, the setting shaft, cam, cam plate and switching means together forming a control device for the main and at least one additional heating elements, rotation of the setting shaft in the angular range regulating the main heating element, rotation beyond the angular range activating the at least one additional heating element, and further rotation thereafter in the angular range regulating both the main and at least one heating elements together.

2. The glass ceramic cooking unit of claim 1, wherein the heating elements are electrical heating resistors.

3. The glass ceramic cooking unit of claim 1, wherein the rectangular configuration of heating elements has rounded corners.

4. The cooking unit of claim 1, wherein the switching means comprises a quick-action switch with stable limiting positions, the quick-action switch having contacts operable in response to movement of the setting member.

5. The cooking unit of claim 4, wherein the quick-action switch comprises a resilient pivotally mounted switching lever.

6. The cooking device of claim 5, wherein the switching lever is arranged laterally and at right angles to the shaft, and the switching lever has a projection directed toward the setting shaft, the switching member further comprising a contact bridge at the free end of the switching lever, the quick-action switch operable to switch between contacts in the contact bridge.

7. The cooking unit of claim 1, wherein the shaft is non-circular in cross-section, the cam being fitted on the setting shaft in form-locked manner, the slot extending along a circle defined by the rotation of the shoulder over an angle of less than 360°, a first and second end of the slot abutting the shoulder upon rotation of the setting shaft.

8. The cooking unit of claim 7, wherein the shaft is generally cylindrical and has a flattened side, the cam having a D-shaped central hole fitting over the shaft in form-locked manner, and the shoulder being formed as an extension extending at right angles from the cam plate.

* * * * *